US008851059B2

(12) United States Patent
Grumbine et al.

(10) Patent No.: US 8,851,059 B2
(45) Date of Patent: Oct. 7, 2014

(54) SELF-CLEANING WIRESAW APPARATUS AND METHOD

(75) Inventors: Steven Grumbine, Aurora, IL (US); Carlos Barros, Addison, IL (US); Ramasubramanyam Nagarajan, Naperville, IL (US)

(73) Assignee: Cabot Microelectronics Corporation, Aurora, IL (US)

( * ) Notice: Subject to any disclaimer, the term of this patent is extended or adjusted under 35 U.S.C. 154(b) by 242 days.

(21) Appl. No.: 13/258,112

(22) PCT Filed: Mar. 30, 2010

(86) PCT No.: PCT/US2010/029144

§ 371 (c)(1), (2), (4) Date: Sep. 21, 2011

(87) PCT Pub. No.: WO2010/120491

PCT Pub. Date: Oct. 21, 2010

(65) Prior Publication Data

US 2012/0006312 A1 Jan. 12, 2012

Related U.S. Application Data

(60) Provisional application No. 61/211,592, filed on Apr. 1, 2009.

(51) Int. Cl.
*B28D 5/04* (2006.01)

(52) U.S. Cl.
USPC .... 125/21; 125/16.02; 125/13.01; 125/16.01; 125/35

(58) Field of Classification Search
CPC .... B28D 5/045; B28D 5/0076; B28D 5/0082; B28D 1/124; B28D 1/05; B28D 1/08; B28D 5/00; B28D 5/007; B24B 55/02; B24B 55/03
USPC ..... 125/21, 16.02, 13.01, 16.01, 35; 451/49, 53, 296, 444, 449, 56, 168, 451/173; 83/168
See application file for complete search history.

(56) References Cited

U.S. PATENT DOCUMENTS

| | | | | | |
|---|---|---|---|---|---|
| 2,946,244 | A * | 7/1960 | Maynard | 408/1 R |
| 3,027,625 | A * | 4/1962 | Milstead | 407/11 |
| 3,831,576 | A * | 8/1974 | Mech | 125/12 |
| 4,536,632 | A * | 8/1985 | Inoue | 219/69.12 |
| 4,971,022 | A * | 11/1990 | Scott et al. | 125/21 |
| 6,018,884 | A * | 2/2000 | Fukunaga et al. | 34/107 |
| 6,065,461 | A * | 5/2000 | Asakawa et al. | 125/16.02 |
| 6,305,183 | B1 * | 10/2001 | Mukai et al. | 62/376 |
| 6,325,079 | B1 * | 12/2001 | Amiran | 134/25.1 |
| 6,328,027 | B1 * | 12/2001 | Persyk et al. | 125/21 |
| 6,390,389 | B1 * | 5/2002 | Tudor et al. | 239/290 |
| 6,390,896 | B1 * | 5/2002 | Huber et al. | 451/59 |
| 6,837,778 | B2 * | 1/2005 | Kondo et al. | 451/49 |
| 6,881,131 | B2 * | 4/2005 | Parsells et al. | 451/53 |

(Continued)

*Primary Examiner* — George Nguyen
(74) *Attorney, Agent, or Firm* — Thomas E Omholt; Robert J. Ross; Steven D Weseman

(57) ABSTRACT

The present invention provides a self-cleaning wiresaw cutting apparatus including a cleaning mechanism adapted to clean the components of the wiresaw before, during, or after a cutting process or to humidify the cutting region of the apparatus. The apparatus contains at least one dispenser adapted to dispense an aqueous fluid onto various components of the wiresaw.

19 Claims, 7 Drawing Sheets

(56) References Cited

U.S. PATENT DOCUMENTS

| | | | | |
|---|---|---|---|---|
| 7,025,054 | B2 * | 4/2006 | Kondo et al. | 125/21 |
| 7,793,647 | B2 * | 9/2010 | Skovgaard-Soerensen | 125/16.02 |
| 8,261,730 | B2 * | 9/2012 | Bakshi et al. | 125/16.02 |
| 2002/0115390 | A1 * | 8/2002 | Kondo et al. | 451/49 |
| 2002/0174861 | A1 * | 11/2002 | Lundt et al. | 125/21 |
| 2006/0260662 | A1 * | 11/2006 | Rastegar et al. | 134/198 |
| 2008/0057836 | A1 * | 3/2008 | Polyak et al. | 451/56 |
| 2008/0295860 | A1 * | 12/2008 | Burger | 134/1 |
| 2009/0104863 | A1 * | 4/2009 | Lin et al. | 451/443 |
| 2010/0300423 | A1 * | 12/2010 | Oshima | 125/21 |
| 2011/0163326 | A1 * | 7/2011 | Matsumoto | 257/76 |
| 2011/0174285 | A1 * | 7/2011 | Nishino et al. | 125/21 |
| 2012/0186571 | A1 * | 7/2012 | Zhu et al. | 125/21 |

* cited by examiner

SELF-CLEANING WIRESAW APPARATUS AND METHOD

This application is the National Stage of PCT/US2010/029144, filed Mar. 30, 2010, which claims the benefit of Provisional Application No. 61/211,592, filed Apr. 1, 2009.

FIELD OF THE INVENTION

This invention relates to a self-cleaning wiresaw apparatus. In particular this invention relates to an apparatus having a dispenser nozzle adapted to clean the components of a wiresaw and methods of cleaning wiresaw components.

BACKGROUND OF THE INVENTION

Wiresaw cutting is the dominant method for slicing ingots into thin wafers for use in the integrated circuits and photovoltaic device (PV) industries. This method is also commonly used for wafering substrates of other materials, such as sapphire, silicon carbide, or ceramic substrates. A wiresaw typically includes one or more spools of fine wire deployed web-like array of wire loops, or a wireweb, where the individual wires have a diameter around 0.1 mm and are arranged in parallel loops, at a loop-to-loop distance of 0.1 to 1.0 mm, by threading the wire through a series of spools, pulleys and wire guides. Slicing or cutting of a workpiece (e.g., a silicon ingot), is accomplished by contacting the workpiece with the wireweb, to which an abrasive cutting fluid (or cutting slurry) has been applied.

Conventional wiresaw abrasive cutting slurries typically comprise a carrier and abrasive particles combined by mixing in a ratio of 1:1 by weight. The carrier is a liquid that provides lubrication and cooling, such as a mineral oil, kerosene, polyethylene glycol, polypropylene glycol or other polyalkylene glycols. The liquid carrier also holds the abrasive to the wire so that the abrasive can contact the workpiece. Aqueous carriers also can be used for wiresaw cutting processes. The abrasive is typically a hard material such as silicon carbide particles.

During the wiresaw cutting process, the cutting slurry coats the wireweb, spools, pulleys, wire guides and other components of the wiresaw. The cutting slurry disperses throughout the wiresaw to portions of the apparatus that are undesirably affected by the cutting slurry. The cutting slurry can clog or jam the various pulleys and wire guides, causing the performance of the wiresaw to decline. The cutting slurry deposited on the wiresaw also can lose moisture and create hard deposits on the wiresaw components. These hard deposits increase the frequency of wire breakage and other wiresaw malfunctions during the wiresaw cutting process.

Accordingly, there is an ongoing need for a self-cleaning wiresaw apparatus that reduces the buildup of cutting slurry on the various portions of a wiresaw. There is an ongoing need for methods and/or apparatus for cleaning wiresaw components and/or ameliorating the drying of cutting slurries on wiresaw components.

BRIEF SUMMARY OF THE INVENTION

The present invention provides a wiresaw apparatus adapted to apply an aqueous cleaning fluid to portions of the wiresaw, e.g., as a spray or mist. The wiresaw of the present invention includes certain conventional components of the type generally known in the art, such as at least one cutting wire looped under tension within wire grooves on at least two wire guide rollers. The tension on the wire can be any suitable tension. In one embodiment, the tension on the wire is 12 N to 32 N. The wire is threaded in multiple loops over wire guide grooves around the wire guide rollers. In one embodiment, the wire may have at least 200 wire loops around the wire guide rollers. The cutting wire is movable with the synchronous rotation of the rollers, which rotate about roller bearings. The wiresaw includes a cutting region that is adapted to receive a workpiece substrate and to urge the substrate against at least one moving cutting wire to cut the substrate. When the workpiece is urged against the loops of moving wire, several wafers of material can be cut from a workpiece simultaneously. The wiresaw apparatus also includes at least one dispenser adapted to apply a cutting slurry to the cutting wire to aid in cutting a substrate with the wire.

In a preferred aspect, the wiresaw apparatus of the present invention includes at least one cleaning fluid dispenser adapted to apply an aqueous cleaning fluid onto at least one of the movable or rotatable wiresaw components. The wiresaw components that the cleaning fluid dispenser is adapted to apply cleaning fluid to include, for example, a cutting wire, a wire guide groove, a wire guide roller, and/or a pulley for directing the wire into or out of the cutting region. The cleaning fluid dispenser dispenses fluid preferably at a pressure in the range of 10 to 160 pounds-per-square inch. The cleaning fluid dispenser can dispense fluid before, during or after cutting the substrate. Preferably, the cleaning fluid is applied while the cutting wire is moving. The cleaning fluid dispenser preferably is located from 1 millimeter to 200 millimeters from a cutting wire. In some preferred embodiments, it is desirable to spray cleaning fluid onto a cutting wire as it exits the cutting region and the rollers, i.e., before being wound onto its take-up spool. The cleaning fluid dispenser can include a nozzle adapted to spray the fluid at an angle of 10 degrees to 150 degrees, and can dispense the aqueous cleaning fluid in a linear, circular, ring-shaped, or square dispersion pattern or a solid stream. The cleaning fluid is preferably dispensed with a gas (e.g. air) to create a mist or to increase the impact of the cleaning fluid In another preferred aspect of this embodiment, the wiresaw apparatus includes a retractable gate that can be positioned in the spray path of one or more cleaning fluid dispenser nozzles to deflect some or all of the spray. The retractable gate also can be positioned so as not to impede the spray path, as desired. The retractable gate can be positioned to deflect a portion of the spray into the cutting slurry supply before or after the spray contacts portions of the apparatus. The retractable gate also can be positioned to deflect a portion of the spray away from the cutting slurry supply, as desired. The retractable gate can be positioned to protect the opening of the cleaning fluid dispenser from slurry splashing and other contamination. One preferred retractable gate is a needle valve that closes the opening that dispenses the cleaning fluid to keep slurry from drying on the opening when not in use. This needle valve is preferably actuated by gas pressure (e.g. a pneumatic actuator coupled to a needle valve) that can be opened to allow both cleaning fluid and a gas to escape in small droplets (e.g. atomized or nebulized). When the retractable gate is retracted, the cleaning fluid dispenser can spray at least one movable or rotatable part of the wiresaw apparatus unimpeded.

In another preferred aspect, the apparatus includes at least one fluid atomizing or nebulizing nozzle adapted to discharge a mist of an aqueous fluid within the cutting chamber. The mist aids in maintaining a suitable humidity level within the cutting chamber and optionally can help maintain the moisture level of the cutting fluid slurry and/or help prevent encrustation of the wiresaw components with dried cutting fluid. The at least one fluid atomizing or nebulizing nozzle is adapted to dispense the aqueous fluid at a rate preferably in the range of 2 liters an hour to 20 liters an hour.

In yet another preferred aspect, the slurry dispenser nozzle is adapted to alternatively apply the aqueous cleaning fluid onto at least one of the wiresaw components when the flow of cutting slurry has been halted. This alternating application of slurry and aqueous cleaning fluid can be aided by a T-connection valve connected to the slurry supply line. The T-connection valve can be a manual valve or an automated valve and can be adjusted to control the type of fluid that is dispensed. The slurry dispenser is adapted to dispense the aqueous cleaning fluid at any suitable pressure or flow volume, preferably at a pressure of 15 pounds-per-square inch to 30 pounds-per-square inch.

Aqueous cleaning fluids useful in conjunction with the apparatus and methods of the present invention preferably include at least a corrosion inhibitor, an anti-drying additive, a surfactant, or air dissolved or suspended in an aqueous medium (e.g. water or a mixture of water and a water-miscible organic solvent) (e.g. an alcohol, a glycol, and the like)). In one embodiment, the aqueous cleaning fluid contains a polyether or polyalcohol (e.g. a polyethylene glycol, glycerin, and the like) at a concentration of 20% to 90%. Preferably the aqueous cleaning fluid comprises, consists of, or consists essentially of water or a water aerosol.

The wiresaw apparatus can include one or more valves adapted to control the amount of aqueous cleaning fluid being discharged by a cleaning fluid dispenser or the amount of slurry being discharged from a slurry dispenser. Various conditions or parameters within the apparatus can be monitored to aid in optimizing the discharge of aqueous cleaning fluid onto portions of the apparatus. For example, a sensor can quantitatively monitor the amount of fluid being discharged from the dispensers by monitoring parameters such as humidity, fluid pressure, fluid volume flow rate, and fluid flow duration. The valve can be adjusted manually or automatically in response to input from such sensors. The valve can be located inside or outside the wiresaw cutting region.

The present invention also provides a method for cleaning components of a wiresaw apparatus by applying an aqueous cleaning fluid from at least one cleaning fluid dispenser that is positioned to spray fluid on at least one moveable or rotatable component of the apparatus (e.g., a cutting wire, a wire guide groove, a wire guide roller and a bearing of a wire guide roller). In one preferred embodiment, at least one cleaning fluid dispenser is positioned to spray fluid from a height that is similar to, or higher than the slurry dispenser and is directed toward a wire guide roller. The fluid dispenser preferably is adapted to apply the fluid at a pressure in the range of 20 to 160 pounds-per-square inch (psi).

The amount of aqueous cleaning fluid that is discharged from the cleaning fluid dispenser preferably is monitored so as to maintain a suitable level of moisture within the cutting region of the apparatus and to prevent undesirable encrustation of movable and rotatable components or the apparatus by dried cutting slurry.

In another method aspect, the present invention also provides a method of maintaining the moisture content of a slurry solution by discharging a mist of an aqueous fluid from a fluid atomizing nozzle that is positioned to discharge mist within a cutting region of a wiresaw.

In yet another method aspect, the present invention also provides a method of cleaning components of a wiresaw by applying an aqueous cleaning fluid from a slurry dispenser that is adapted to alternatively apply a cutting slurry and an aqueous cleaning fluid onto at least one moving or rotatable component of the apparatus (e.g., a cutting wire or roller guide).

DETAILED DESCRIPTION OF THE INVENTION

Figure 1:
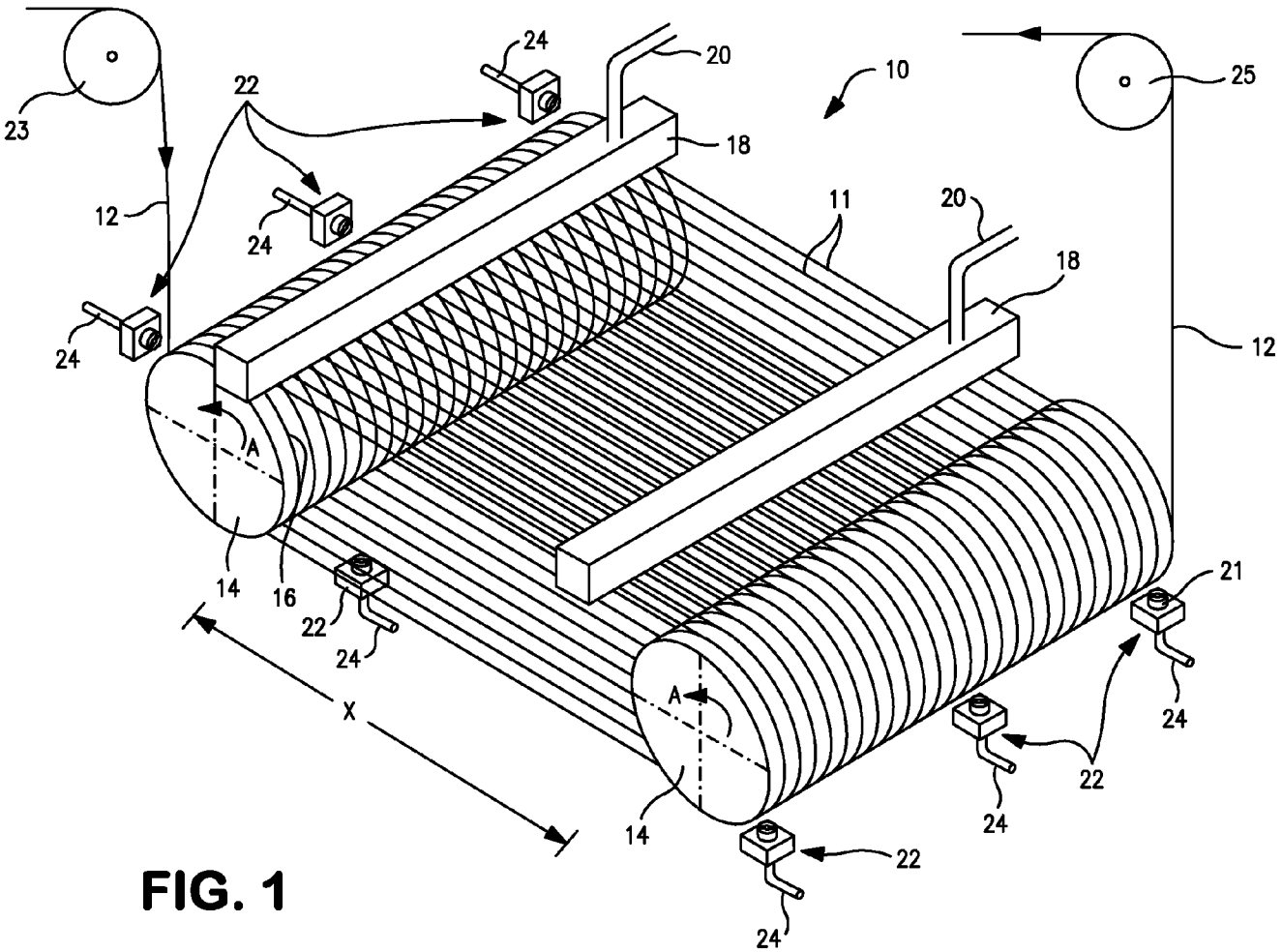
FIG. 1 is a partial perspective view of an embodiment of a self-cleaning wiresaw cutting apparatus of the present invention.

The invention disclosed herein is susceptible of embodiments in many different forms. Shown in the drawings and described herein in detail are preferred embodiments of the invention. It is to be understood, however, that the present disclosure is an exemplification of the principles of the invention and does not limit the invention to the illustrated embodiments.

A preferred embodiment of a self-cleaning wiresaw cutting apparatus of the present invention is shown in FIG. 1. Wiresaw apparatus 10 is adapted to apply an aqueous cleaning fluid to portions of the wiresaw as a spray or mist before, after, and/or during operation of the wiresaw. Wiresaw apparatus 10 includes cutting wire 12 disposed in multiple cutting loops 11 over first and second rollers 14. Wire guide grooves 16 are located on the surface of rollers 14 to maintain a constant spacing or pitch between loops 11. Rollers 14 are separated from one another by distance X, which is determined by the desired length of loops 11. Wire 12 receives a tension force when engaged with the rollers 14, such that wire 12 moves in the direction of the arrow heads shown on wire 12, impelled the synchronous rotation of rollers 14. Wire 12 is supplied from a supply spool (not shown) and is guided onto a first roller 14 by pulley 23. After traversing the two rollers 14 in several loops 11, wire 12 is guided off of the second roller 14 by pulley 25 and is directed onto a take-up spool (not shown).

Slurry dispensers 18 are located above loops 11, offset from the axes of rollers 14, and are adapted to dispense a cutting slurry onto cutting loops 11 to aid in cutting a workpiece substrate (not shown) that is urged against moving loops 11. The cutting slurry is supplied to slurry dispensers 18 via slurry supply lines 20. Slurry dispensers 18 are adapted to dispense a cutting slurry of the type generally know in the art, e.g., a slurry comprising a particulate abrasive suspended in an aqueous and/or polyethylene glycol medium. Slurry dispensers 18 preferably can each dispense the cutting slurry at a flow rate in the range of 800 to 4000 Kg/hour.

The region of wire loops between the roller 14 defines a "cutting region" were a workpiece is cut by urging the substrate against the moving wire loops 11, which cut into the substrate by friction, aided by the abrasive slurry. The number of loops 11 and the size of the work piece establishes the number of cuts that will be made in the workpiece. The lateral spacing of loops 11 determines the distance between cuts and is often referred to as the pitch, which is determined by the grooves in the roller. The pitch, along with the wire diameter and the size of the abrasive particles in the cutting fluid, determine the width of a wafer that is cut from the workpiece. Typical wafer widths are 100 to 300 μm for photovoltaic applications and 600 to 1000 μm for semiconductor applications.

In this embodiment of the apparatus of the present invention, cleaning fluid dispensers 22 are located near various moving components of wiresaw 10. Cleaning fluid dispensers 22 are adapted to dispense an aqueous cleaning fluid at selected pressure in the range of 20 pounds-per-square inch to 160 pounds per square inch. The aqueous cleaning fluid can contain a variety of useful additives, including for example, a corrosion inhibitor such as an alkyl phosphate or alkyl phosphonate, a surfactant such as an alkyl sulfate, and/or an aerosol gas such as air. The cleaning fluid is supplied to cleaning fluid dispensers 22 via one or more cleaning fluid supply lines 24. Preferably, the fluid is or consists essentially of predominately water.

As shown in FIG. 1, cleaning fluid dispensers 22 are positioned near the rollers 14 and wire guide grooves 16 situated thereon. Cleaning fluid dispensers 22 can be positioned to spray any of the moving components of wiresaw 10, including, e.g., the wire 12, loops 11, rollers 14, wire guide grooves 16, or pulleys 23 and 25. Cleaning fluid dispensers 22 can be located within the cutting region of the wiresaw or outside of this region, or both. In one preferred embodiment, cleaning fluid dispensers 22 are adapted to spray the cutting wire 12 after the wire has exited rollers 14 and the cutting region. Cutting wire 12 preferably is sprayed with a cleaning fluid as it is moving through wiresaw 10.

Figure 2:
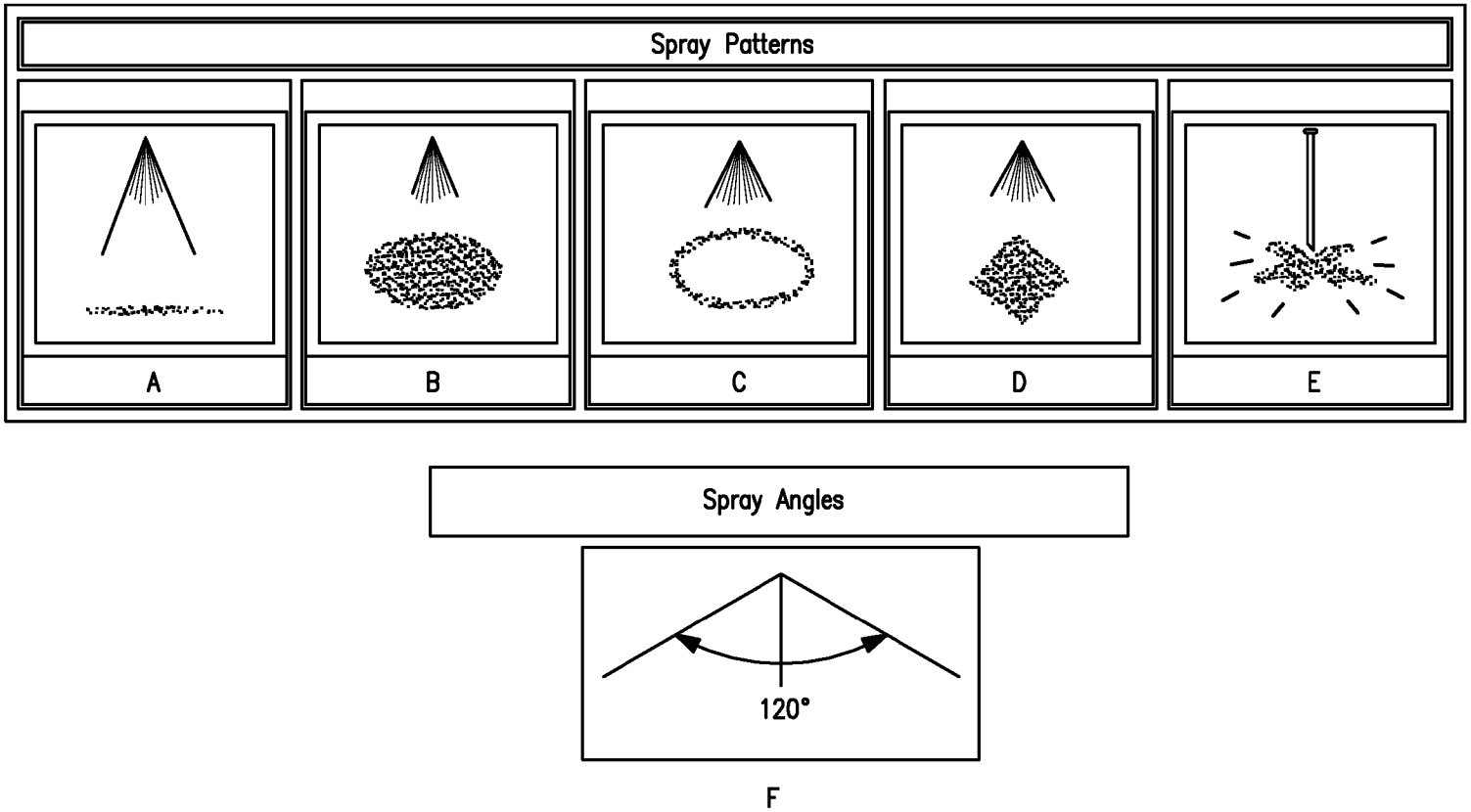
FIG. 2 is an illustration of certain spray patterns created by a dispenser useful in the present invention.

In the embodiment of FIG. 1, cleaning fluid dispenser 22 each comprise a nozzle that can discharge fluid in a selected spray pattern. Some exemplary spray patterns are illustrated in FIG. 2. The nozzle and spray pattern for a given apparatus can be selected and/or optimized based on a number of factors, such as, for example the desired number an positioning of the dispensers, the particular parts to be cleaned, the location of the parts to be cleaned, and the like. For example, in some embodiments, dispensers 22 can be adapted to dispense a cleaning fluid in a linear or "flat" pattern as shown in FIG. 2, panel A. A flat pattern is particularly effective for limiting fluid contact to a linear-shaped portion of the wiresaw. In another embodiment, dispensers 22 can dispense fluid in a full cone pattern as shown in FIG. 2, panel B. A full cone pattern is particularly effective for dispensing fluid onto the full surface area bounded by a circle. Alternatively, dispensers 22 can be adapted to dispense fluid in a hollow cone pattern as shown in FIG. 2, panel C. A hollow cone pattern is particularly effective for dispensing fluid around a circular perimeter. In another alternative, dispensers 22 can dispense fluid in a square pattern as shown in FIG. 2, panel D. A square spray pattern covers a square-shaped area on the wiresaw 10. In yet another embodiment, dispensers 22 can be adapted to dispense the fluid in a solid stream as shown in FIG. 2, panel E. This solid stream pattern is particularly effective in flushing a general area of the wiresaw 10 with a large amount of fluid, e.g., after a cutting operation is completed. These and other spray patterns can be created with dispensers 22 as desired. If desired, the spray pattern of each dispenser 22 in apparatus 10 can be independently configured.

Preferably, cleaning fluid dispensers 22 can discharge fluid in any of these spray patterns at dispersion angle ranging from 10 degrees to 150 degrees as measured by the angle subtended by lines parallel to the outer edges of the spray pattern. A 120 degree spray angle of the type that can be created by the cleaning fluid dispenser 22 is show in FIG. 2, panel F.

Figure 3:
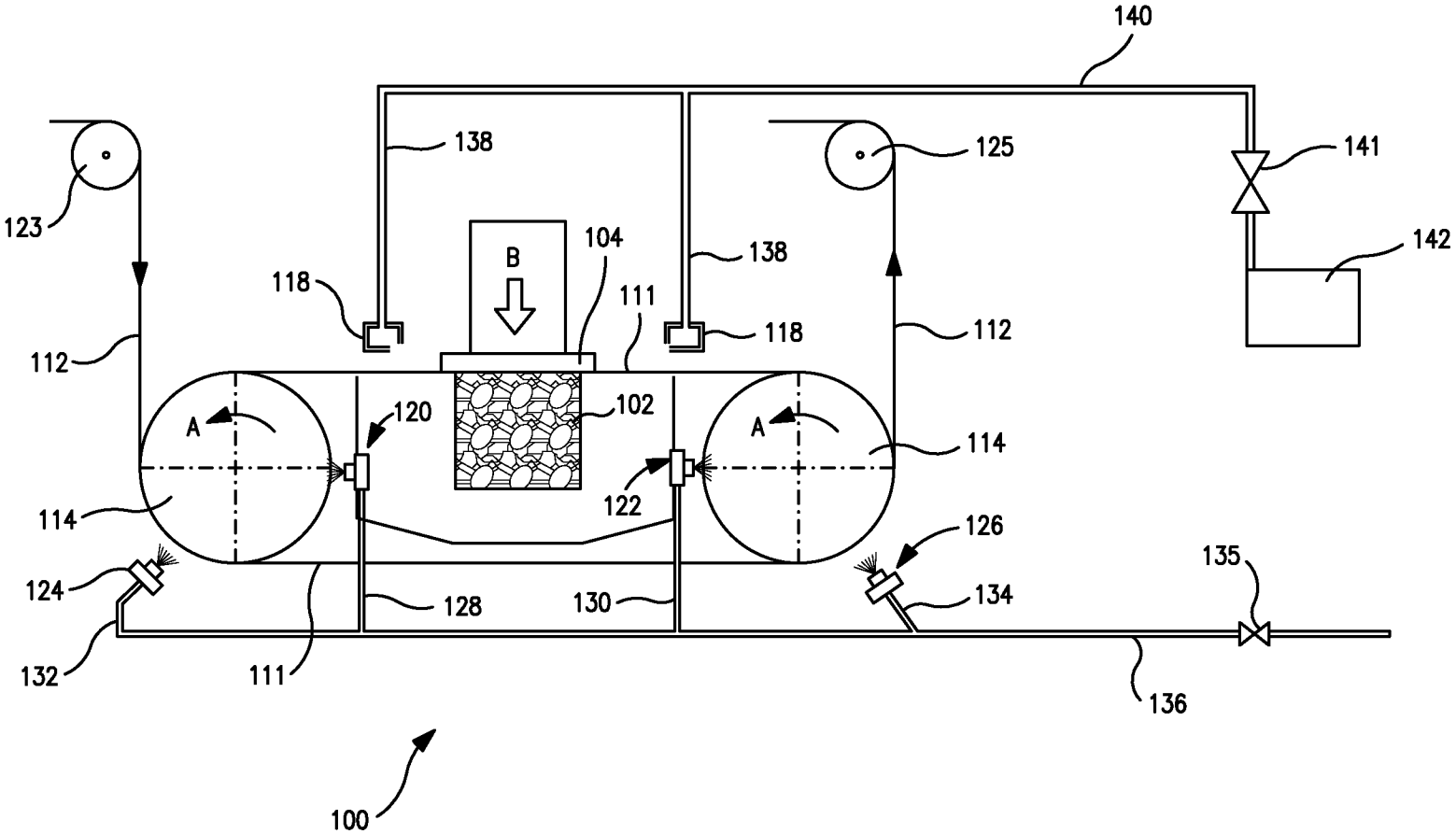
FIG. 3 schematically illustrates components of one embodiment of a self-cleaning wiresaw cutting apparatus of the present invention.

FIG. 3 provides a partial schematic side view of a wiresaw system 100, in which a workpiece 102 is positioned in the cutting region of the wiresaw 100 located between first and second rollers 114 at the general location where moving wire loops 111 contact the workpiece 102. Workpiece 102 is of the type generally known in the art, such as a silicon ingot. In this embodiment, rollers 114 synchronously rotate in counterclockwise direction "A" thereby impelling wire 112 in the direction of the arrow heads shown on wire 112. The workpiece 102 is mounted on plate 104, which urges workpiece 102 in direction "B" toward moving loops 111, to thereby cut workpiece 102 into wafers. As is known in the art, wire 112 is supplied by a supply spool (not shown) and is guided onto a first roller 114 by pulley 123. After traversing the first and second rollers 114 several times, wire 112 is guided off of second roller 114 and onto a take-up spool (not shown) as is known in the art.

System 100 contains multiple cleaning fluid dispensers 120, 122, 124, 126 pointing toward the wire 112 and rollers 114. Branch supply lines 128 and 130 supply cleaning fluid to the dispensers 120, 122 located within the cutting region of the wiresaw 100. These internal dispensers 120, 122 spray the wire guides of the rollers 114 in the section of the rollers where the wires 112 are not present. Spraying this area of the rollers 114 allows the cleaning fluid to effectively clean the wire guide grooves on the roller without the wire 112 deflecting the cleaning fluid.

Branch supply lines 132 and 134 supply cleaning fluid to the dispensers 124, 126 located outside of the cutting region of wiresaw 10. These external dispensers 124, 136 can dispense the cleaning fluid onto wire 112 as it exits the roller. Branch supply lines 128, 130, 132, 134 are branched from main cleaning fluid supply line 136. The flow of fluid in line 136 can be controlled or modulated by valve 135.

The wiresaw cutting system 100 also contains slurry dispensers 118 adjacent to the loops 111, offset from the axes of first and second rollers 114. Branch slurry supply lines 138 supply slurry to slurry dispensers 118. Branch slurry supply lines 138 are branched from main slurry supply line 140. The flow of slurry in line 140 can be controlled by valve 141.

Figure 4:
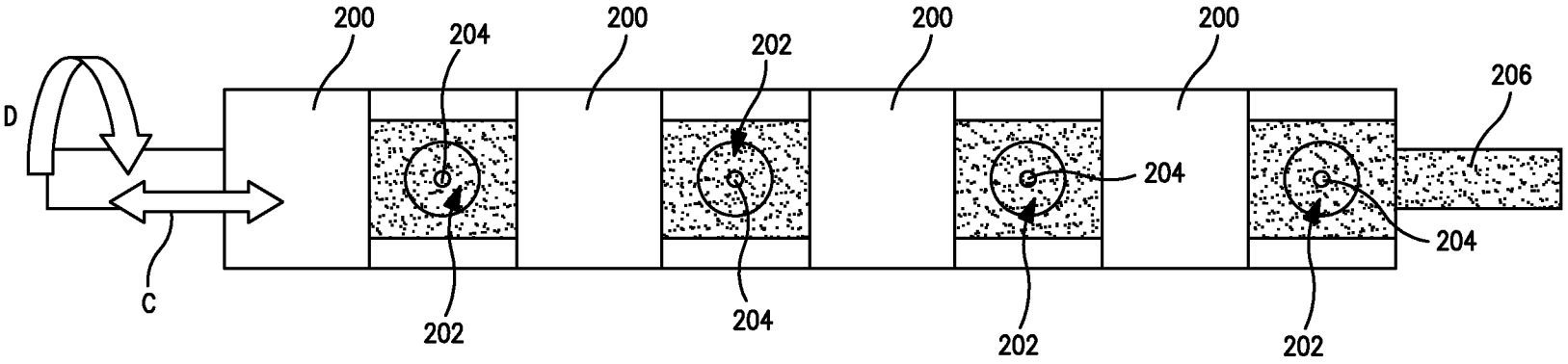
FIG. 4 schematically illustrates a retractable dispenser assembly useful in certain embodiments of the present invention.

FIG. 4 schematically illustrates an array of retractable cleaning fluid dispensers 202 operably connected to fluid supply line 206, and including retractable gates 200, which are positioned near cleaning fluid dispensers 202. Retractable gates 200 are laterally moveable (as indicated by double-headed arrow C, such that the gates can be positioned in front of nozzles 204 of dispensers 202, e.g., to protect nozzle 204 from slurry splashing or other contamination, or to deflect some or all of the spray from the cleaning fluid dispenser nozzles. Cleaning fluid dispensers 202 can also rotate (as indicated by arrow D), such that the nozzles 204 are not exposed to external elements.

When gates 200 are positioned in front of nozzles 204, the spray of aqueous cleaning fluid is deflected. The deflected aqueous cleaning fluid can be directed into the cutting slurry supply to replace water lost by evaporation. Alternatively, the deflected fluid can be directed away from the cutting slurry supply to avoid diluting the slurry to an undesirable concentration, as desired. The position of gates 200 and/or dispensers 202 can be adjusted to alternate between directing spray toward and away from the cutting slurry supply. In addition, the position of gates 200 and/or dispensers 202 can be adjusted to allow the cleaning fluid to flow into the cutting slurry after it has contacted portions of the wiresaw. When gates 200 are positioned away from nozzles 204, the dispensers can directly spray aqueous cleaning fluid onto portions of the wiresaw.

Another configuration of the self-cleaning wiresaw cutting apparatus of the present invention includes two or more dispensers (e.g., sprayers) in close proximity to each other, and directed toward a wire with an angle of incidence between the dispensers of at least 60 degrees. It is preferred that the dispensers are adapted to spray cleaning fluid onto the same piece of wire after it exits the cutting zone (e.g. the roller guides). Preferably, the dispensers are positions within 20 cm of each other and most preferred within 10 cm of each other.

Figure 5:
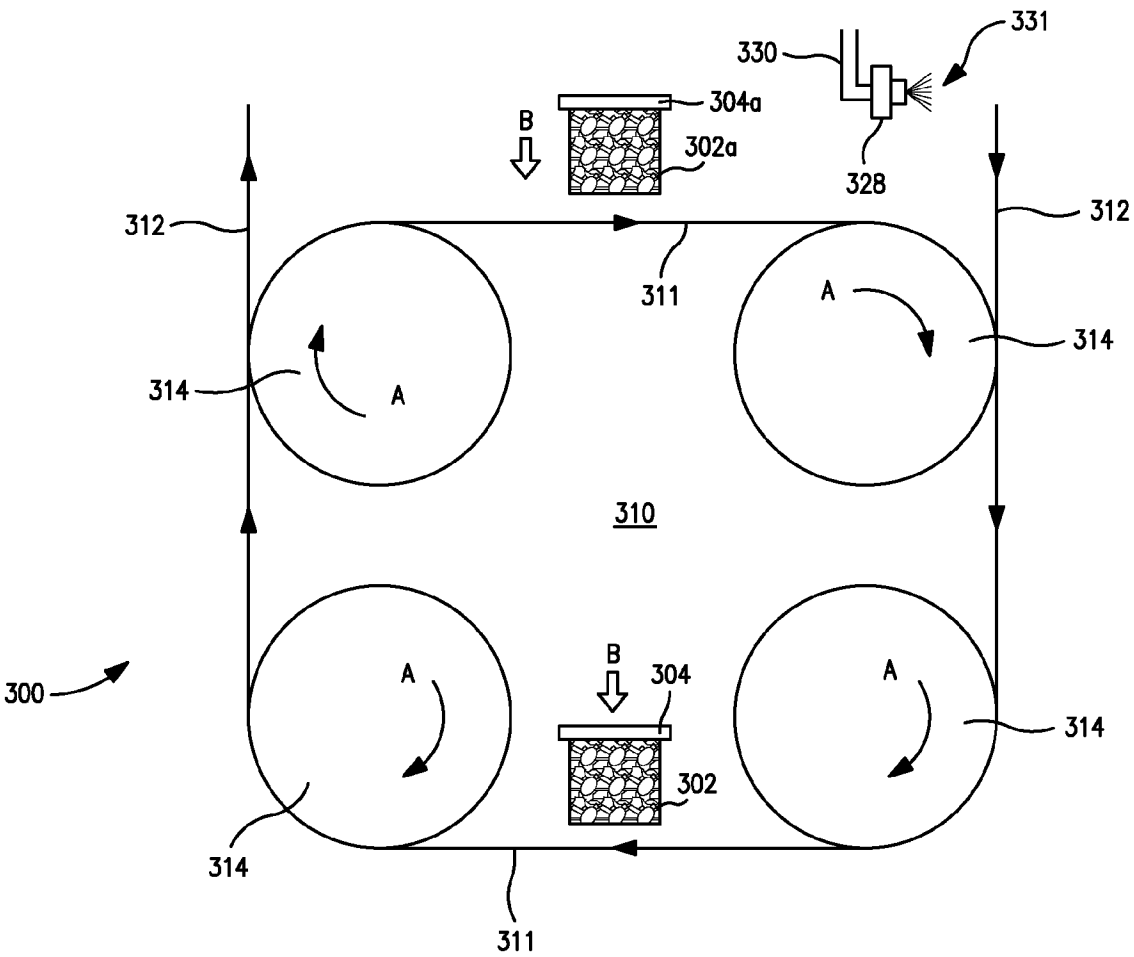
FIG. 5 is a partial side schematic view of another embodiment of a self-cleaning wiresaw cutting apparatus of the present invention.

FIG. 5 schematically illustrates a partial, side view of the cutting region of another configuration of the wiresaw cutting apparatus of the present invention. In this embodiment, apparatus 300 includes four rollers 314, with cutting wire 312 riding in multiples loops 311 around rollers 314. As rollers 314 synchronously rotate in direction "A", wire 312 is impelled in the direction indicated by the arrow heads shown on wire 312. Apparatus 300 includes two mounting plates 304 and 304*a*, to urge two separate work pieces 302 and 302*a*, respectively, against moving loops 311 to cut the work pieces into wafers. Mounting plate 304 is located in region 310, within loops 311, whereas mounting plate 304*a* is located above loops 311. The apparatus of FIG. 5 includes an atomizing cleaning fluid dispenser 328, which is supplied with an aqueous fluid, such as water, from supply line 330. Dispenser 328 is adapted to dispense an atomized mist of aqueous fluid 331 in or near the cutting region to maintain the humidity in the cutting region at a level sufficient to retard drying of the slurry on the moving parts of the apparatus, and/or to maintain the moisture level of the slurry within a desired range.

Figure 6:
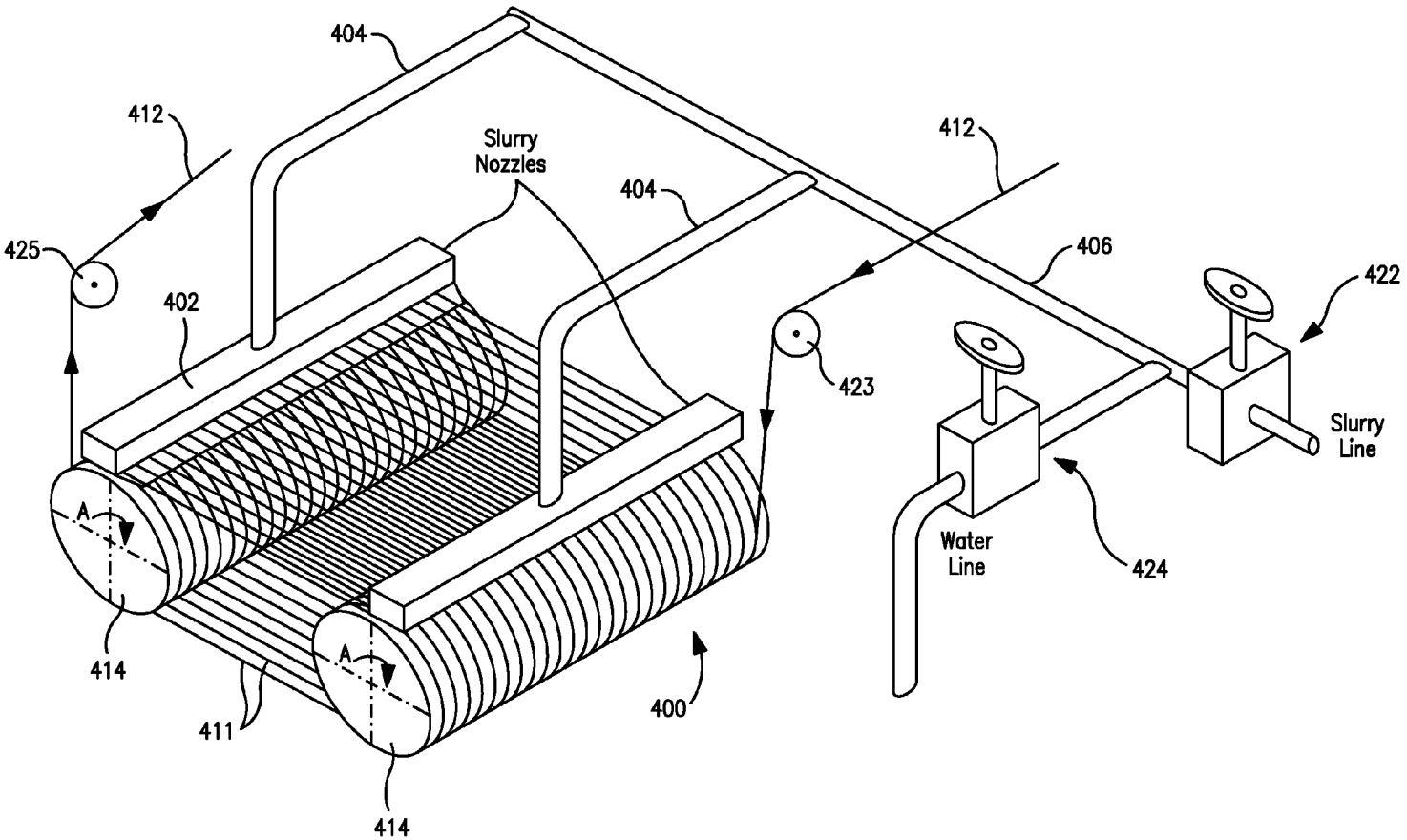
FIG. 6 is a partial perspective view of an alternative embodiment of a wiresaw cutting apparatus of the present invention.

Another configuration of the self-cleaning wiresaw cutting apparatus of the present invention, including one or more of the cutting slurry dispensers adapted to alternatively dispense a cleaning fluid, is schematically depicted in FIG. 6. In this embodiment 400, cutting wire 412 is supplied from a supply spool (not shown) and guided onto first roller 414 by pulley 423. Wire 412 is disposed in several loops 411 over first and second rollers 414. Wire 412 is guided off of second roller 414 by pulley 425, and is collected in a take-up spool (not shown) as is known in the art. Hybrid dispensers 402 are attached to supply lines 404, which branch from hybrid supply line 406. Hybrid supply line 406 contains is interfaced upstream from the branch supply lines 404 with a slurry supply valve 422 and an independently operating cleaning fluid or water line valve 424. Valves 422 and 424 can be individually adjusted to provide any desired mix of slurry and aqueous fluid to the dispenser nozzle 402 (e.g., only slurry, only cleaning fluid, or a proportioned mixed thereof). For example, the apparatus can be operated during cutting by supplying a cutting slurry through dispensers 402, and then after cutting is terminated, a cleaning fluid can be discharged from dispensers 402 to clean the cutting wire loops, rollers, and the like. The dispenser nozzles may be pointed directly down onto the loops of cutting wire. Alternatively, the dispenser nozzles may be pointed at any suitable angle in relationship to the loops of cutting wire (e.g. at a 45° angle, or at a 60° angle).

Figure 7:
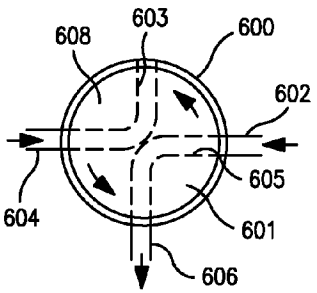
FIG. 7 is a schematic illustration of a diverter valve that can be included in certain embodiments of the present invention.

Alternatively, or in addition, supply line 406 can include a diverter valve such as valve 600, shown in FIG. 7, to alternately supply either cutting slurry or cleaning fluid to supply lines 404. Fluid can enter valve 600 via fixed position cleaning fluid supply line 602 or fixed position slurry supply line 604. Fixed discharge line 606 allows fluid to exit valve 600. Valve stem 601 defines internal channels 603 and 605 denoted by dotted lines in FIG. 7. Valve stem 601 is configured to rotate in to switch the valve intake between cleaning fluid supply line 602 and slurry supply line 604, as denoted by the curved arrows. The position of valve stem 601 shown in FIG. 7 is oriented to allow flow from cleaning supply line 602 into discharge line 606. Rotating valve stem 601 counter-clockwise switches the flow path so that cutting slurry is discharged through line 606. Rotating valve stem 601 back in the clockwise direction would then reestablish the flow of cleaning fluid and terminate the flow of cutting slurry.

Figure 8:
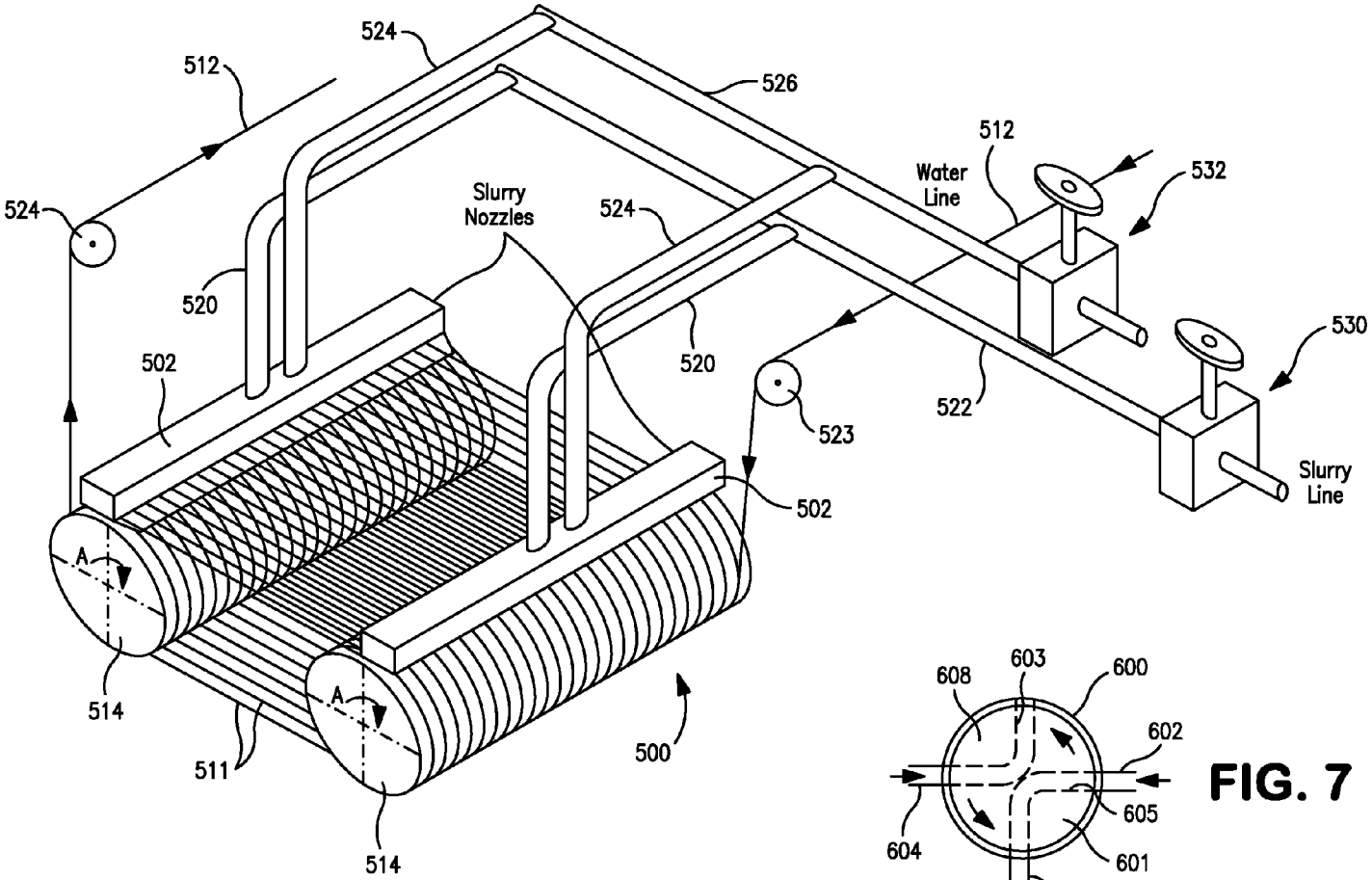
FIG. 8 is a partial perspective view of an alternative embodiment of a wiresaw cutting apparatus of the present invention.

Another alternative embodiment is shown in FIG. 8. Hybrid dispensers 502 are located near wires 512 and rollers 514 of wiresaw device 500. Hybrid dispensers 502 are attached to branch supply lines 520, 524, respectively. Slurry branch lines 520 connect to hybrid dispensers 502 to slurry supply line 522. Cleaning fluid branch lines 524 connect to hybrid dispensers 502 to cleaning fluid supply lines 526. Slurry control valve 530 is located on slurry supply line 522 upstream from slurry branch lines 520, and can be opened to allow dispensers 502 to dispense a cutting slurry. Cleaning fluid control valve 532 is located on cleaning fluid supply line 526 upstream from cleaning fluid branch lines 522. Cleaning fluid valve 532 can be opened to allow dispensers 502 to dispense cleaning fluid. By adjusting valves 530 and 532, the wiresaw 500 of FIG. 8 can be configured to spray either slurry or cleaning fluid, or both from the same dispenser 502. The dispenser nozzles may be pointed directly down onto the loops of cutting wire. Alternatively, the dispenser nozzles may be pointed at any suitable angle in relationship to the loops of cutting wire (e.g. at a 45° angle, or at a 60° angle).

Another embodiment of the self-cleaning wiresaw cutting apparatus of the present invention includes a cleaning fluid dispenser such as those described in FIGS. 1-8, which is used with a cleaning fluid comprising at least 30% by weight of a poly glycol (e.g., polyethylene glycol, polypropylene glycol, an ethylene glycol/propylene glycol copolymer, and the like) and a cutting abrasive slurry comprising a particulate abrasive suspended in an aqueous medium, wherein the aqueous medium comprises at least 80% by weight water. The cleaning fluid is dispensed after the wire loops have cut through the substrate, creating wafers.

Preferably, the cleaning fluid dispensers and slurry dispensers are controlled by valves, which can be manually controlled or automated. Automated valves can be controlled by a computer processing unit (CPU) of the type generally known in the art. The automated valve can be adapted to activate or deactivate the dispensers based upon various criteria or parameters. For example, the automated valves can be adapted to respond to a signal from a sensor that monitors the amount of fluid being discharged from the dispenser, and to turn off a dispenser after a certain amount of fluid has been discharged. Such quantitative monitoring can be achieved using sensors that monitor parameters such as humidity in the cutting region, fluid pressure in the lines or at the dispenser heads, fluid volume flow rate within the lines, and fluid flow duration.

The manual or automatic valves can be positioned in any suitable location, e.g., at a T-connection interface between branch lines and main supply lines. Alternatively, the valves can be located near the dispenser itself, or near the fluid supply at the upstream portion of the supply lines. The valves can be located within the cutting region of the wiresaw, or outside of the cutting region.

The number of dispensers contained in the wiresaw apparatus of the present invention can vary based upon the portions of the wiresaw desired to be cleaned. In one preferred embodiment, each end of the wire exiting or entering the roller has at least one cleaning fluid dispenser. In another preferred embodiment each wire guide in the wiresaw has at least one fluid dispenser nozzle associated with it. The dispensers of the present invention can be located a variety of distances from the components of the wiresaw. In a preferred embodiment, the dispensers are located between 1 millimeter and 200 millimeters from a cutting wire.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. A self-cleaning wiresaw apparatus comprising:

at least one cutting wire looped under tension within wire guide grooves on at least two rotatable wire guide rollers, the cutting wire being movable with the synchronous rotation of rollers;

a cutting region adapted to receive a substrate and to urge the substrate against the cutting wire to cut the substrate therewith;

at least one slurry dispenser adapted to dispense a cutting slurry from a supply thereof onto the moving cutting wire to aid in cutting the substrate; and at least one cleaning fluid dispenser adapted to dispense an aqueous cleaning fluid at a pressure in the range of about 10 to about 160 pounds-per-square inch (psi) onto at least one movable or rotatable portion of the apparatus to clean the portion of the apparatus before, during or after cutting a substrate therewith, wherein the apparatus further comprising a retractable gate positionable to deflect the spray of aqueous cleaning fluid from at least one cleaning fluid dispenser or positionable to protect the opening of the cleaning fluid dispenser from most slurry splashing, and retractable so as to allow the at least one cleaning fluid dispenser to directly dispense the aqueous cleaning fluid onto at least one movable or rotatable portion of the apparatus.

2. The apparatus of claim 1 wherein at least one cleaning fluid dispenser nozzle is a adapted to spray the aqueous cleaning fluid onto a portion of the apparatus selected from the group consisting of a cutting wire, a wire guide groove, a wire guide roller, and a pulley.

3. The apparatus of claim 1 wherein the tension on the wire is about 12 N to about 32 N.

4. The apparatus of claim 1 wherein the apparatus is adapted to direct at least a portion of the aqueous cleaning fluid into the supply of cutting slurry after it contacts the movable or rotatable portion of the apparatus.

5. The apparatus of claim 1 wherein the aqueous cleaning fluid contains at least one of a corrosion inhibitor, an anti-drying additive, a surfactant, and air.

6. The apparatus of claim 1 wherein the apparatus includes at least one cleaning fluid dispenser adapted to dispense the aqueous cleaning fluid onto at least one cutting wire as the cutting wire is moving.

7. The apparatus of claim 1 further comprising a valve that is adapted to control the amount of aqueous cleaning fluid being dispensed from at least one cleaning fluid dispenser.

8. The apparatus of claim 7 wherein the apparatus is adapted to quantitatively monitor the amount of the aqueous cleaning fluid being dispensed from at least one cleaning fluid dispenser.

9. The apparatus of claim 1 wherein the at least one cutting wire looped under tension within wire guide grooves on at least two rotatable wire guide rollers has at least 200 wire loops around the wire guide rollers.

10. The apparatus of claim 7 wherein at least one cleaning fluid dispenser includes a valve that is located external to the cutting region of the wiresaw.

11. The apparatus of claim 1 wherein at least one cleaning fluid dispenser is located at a distance of about 1 mm to about 200 mm from a cutting wire.

12. The apparatus of claim 1 wherein at least one cleaning fluid dispenser is adapted to dispense the aqueous cleaning fluid at a spray angle of about 10 degrees to about 150 degrees.

13. The apparatus of claim 1 wherein at least one cleaning fluid dispenser is adapted to dispense the aqueous cleaning fluid in a dispersion pattern selected from the group consisting of a linear pattern, a circular pattern, a ring-shaped pattern, a square pattern, and a solid stream.

14. A self-cleaning wiresaw apparatus comprising:

at least one cutting wire looped under tension within wire guide grooves on at least one pair of rotatable wire guide rollers, the cutting wire being movable with the synchronous rotation of the pair of rollers;

a cutting region adapted to receive a substrate and to urge the substrate against at least one moving cutting wire to cut the substrate therewith; and at least one slurry dispenser adapted to dispense a cutting slurry from a supply thereof onto the moving cutting wire to aid in cutting the substrate;

wherein at least one slurry dispenser is further adapted to alternatively dispense an aqueous cleaning fluid onto at least one movable or rotatable portion of the apparatus before, after, or intermittently during the process of cutting a substrate therewith to clean the portion of the apparatus.

15. The apparatus of claim 14 wherein at least one slurry dispenser is adapted to dispense the aqueous cleaning fluid onto a portion of the apparatus selected from the group consisting of a cutting wire, a wire guide groove, a wire guide roller, and a pulley.

16. The apparatus of claim 14 wherein the apparatus is adapted to direct a majority of the aqueous cleaning fluid away from the supply of cutting slurry after it contacts the movable or rotatable portion of the apparatus.

17. The apparatus of claim 14 wherein the aqueous cleaning fluid contains at least one of a corrosion inhibitor, an anti-drying additive, a surfactant, and air.

18. The apparatus of claim 14 wherein the apparatus further includes at least one dispenser adapted to dispense the aqueous cleaning fluid onto at least one cutting wire as the cutting wire exits the cutting region and the rollers of the wiresaw.

19. The apparatus of claim 14 wherein the slurry dispenser is adapted to spray an aqueous cleaning fluid at a pressure in the range of about 15 to about 30 pounds-per-square inch (psi).

* * * * *